US006011938A

United States Patent [19]

Toizumi

[11] Patent Number: 6,011,938

[45] Date of Patent: Jan. 4, 2000

[54] FIXING DEVICE IN IMAGE FORMING DEVICE

[75] Inventor: Kiyoshi Toizumi, Yamatokooriyama, Japan

[73] Assignee: Sharp Kabushiki Kaisha, Osaka, Japan

[21] Appl. No.: 09/119,109

[22] Filed: Jul. 20, 1998

[30] Foreign Application Priority Data

Jul. 24, 1997 [JP] Japan ..... 9-198327

[51] Int. Cl.[7] ..... G03G 15/20

[52] U.S. Cl. ..... 399/69; 399/70; 219/216; 219/469; 432/60

[58] Field of Search ..... 399/69, 70, 324; 118/60; 219/216, 469, 470; 432/60

[56] References Cited

U.S. PATENT DOCUMENTS

| | | | |
|---|---|---|---|
| 4,642,448 | 2/1987 | Shigemura et al. | 219/216 |
| 4,878,092 | 10/1989 | Arai | 399/70 |
| 5,528,346 | 6/1996 | Kim et al. | 219/216 |
| 5,682,577 | 10/1997 | Kiyoi | 399/70 |
| 5,708,920 | 1/1998 | Ohnishi et al. | 399/69 |
| 5,742,870 | 4/1998 | Hwang | 399/70 |

FOREIGN PATENT DOCUMENTS 4-295873 10/1992 Japan .

*Primary Examiner*—William Royer
*Assistant Examiner*—William A. Noē
*Attorney, Agent, or Firm*—Dike, Bronstein, Roberts & Cushman, LLP; David G. Conlin; William J. Daley, Jr.

[57] ABSTRACT

To improve the fixing ability in the fixing device, and simultaneously prevent hot offset occurring during continuous fixing process. In the interior of a cored bar of a heat roll is mounted a heater lamp, and by controlling the power supplied to said heater lamp, heat roll is maintained at a first set temperature enabling heat fix. To this heater lamp is pressed a pressurization roll formed by covering a cover layer to a cored bar, which forms a fixing device. The heat roll is controlled and maintained at the first set temperature $T_1$ at the initial fixing process, and when performing a continuous fixing process, it is switched and controlled to a second set temperature $T_2$ lower than the first set temperature but enabling fixing. Thereby, the fixing ability could be maintained well, preventing hot offset.

6 Claims, 6 Drawing Sheets

FIXING DEVICE IN IMAGE FORMING DEVICE

BACKGROUND OF THE INVENTION

The present invention relates to a fixing device for heat-fixing a prefixed toner on a sheet which is the image holding body equipped in an image forming device such as copying machines, laser beam printers and the like utilizing an electrophotograph method.

The image forming device utilizing an electrophotograph method creates a manifest image by powder toner from a latent image formed on a photosensitive body having a photosensitive layer which works as a recording medium, and transfers said latent toner image onto a sheet-type paper which is the image holding body, and since said toner is yet to be fixed, heat is applied to melt the toner, and then pressure is added thereto to fix said toner image onto the paper. In order to do so, a fixing device is provided on the lower stream side of a paper conveyance passage, for example, just before a discharge portion of the paper which passes through an image forming region.

A conventional temperature control in the fixing device is disclosed for example in Japanese Laid-Open Patent Publication No. 4-295873. It is operated so as to turn the heater lamp on continuously so as to rapidly raise the surface temperature of the heat roll to the aimed set temperature Ts, in response to turning on of the power of a copying machine and the like.

Further, by detecting the reaching of a temperature To which is under the object set temperature Ts, the power supply is controlled so as to turn the heater on and off periodically, so as to prevent an overshooting caused by the rapid raise of surface temperature, reducing the ripple caused by the difference in temperature after reaching the object set temperature Ts.

Therefore, a temperature (the second temperature) To which is not aimed at performing fixing, which is lower than the set temperature (first temperature) Ts enabling fixing as the object temperature, is set in correspondence to said temperature Ts, and from the point of time where said second temperature To is detected, the control of power being supplied to the heater lamp is performed. According to such operation, the overshooting after reaching the first temperature Ts is reduced, and unnecessary power supply and the like are restrained.

According to the heat control of the fixing device disclosed in the above-mentioned publication, it is effective to control the heat roll for controlling the temperature to said first temperature Ts enabling fixing, and it is advantageous in that unnecessary power supply and the like when turning on the power could be restrained. Further, it is effective in that the ripple and the like after reaching said first temperature Ts could be minimized.

However, in the fixing device, after reaching the first temperature Ts enabling fixing, temperature control is performed constantly targeting the first temperature Ts, without changing the set temperature. Therefore, when continuous image forming is performed at the image forming portion, the heat roll and the like must be continuously rotated in order to perform a continuous fixing process at the fixing device. At this time, the heat roll is controlled and maintained to said first temperature Ts by controlling the power supplied to the heater lamp. Therefore, the lower pressing roll will be heated by the upper heat roll, and the surface temperature thereof will be raised gradually.

Therefore, the fixing performance at the fixing device when performing a continuous image forming will differ gradually between the initial image forming and during the continuous image forming. When using thin paper (for example, 60 g paper), hot offset will occur. In other words, since the surface temperature of the pressing roll is heated sufficiently and raised, the sheet of paper will also be heated from the back surface. Therefore, the toner heated by said upper heat roll is not only melted and fixed to the surface of the sheet, but also adhered to the heat roll side.

Therefore, aimed at solving the hot offset, the control temperature of the heat roll may be controlled to maintain a temperature set in advance enabling fixing but lower than the first temperature Ts. However, when setting a temperature enabling fixing which is lower than the first temperature Ts, and controlling the device to maintain this temperature constantly, a predetermined fixing performance could not be gained if the sheet of paper is thick. That is, much of the heat of the heat roll will be taken by the thick sheet, and the surface temperature of the heat roll will be reduced rapidly. Accordingly, the fixing performance will be reduced when heat-fixing the toner on the following sheets, which produces problems such as the reduction of fixing ability, fixture disorder, and reduction of brightness in the case of colored images.

SUMMARY OF THE INVENTION

The object of the present invention, therefore, is to solve the above-mentioned problems, and provide a fixing device having at least two kinds of temperatures enabling fixing of the heat roll even when performing continuous fixing process, solving the problem of hot offset, and simultaneously maintaining a regular fixing ability.

Especially, the present invention is aimed at providing a fixing device where the temperature enabling fixing is changed according to the state of the fixing process during such process, providing a stable fixing, and preventing hot offset.

Further, it is the second object of the present invention to achieve the above-mentioned objects, and simultaneously reduce power consumption.

In order to achieve the above-mentioned objects, the fixing device of the image forming device according to the present invention comprises a heat roll having a surface thereof being heated to a desired temperature through a heating source, and a pressurization roll for closely contacting an image holding body pressurized and conveyed by said heat roll towards said heat roll side, the surface of said heat roll being controlled to maintain a temperature enabling to fix a prefixed toner image formed on said image holding body by controlling a power supply to said heating source; wherein said heat roll is controlled to a first set temperature enabling fixing, and on the other hand, switching the temperature between a second set temperature enabling fixing which is lower than said first set temperature, corresponding to the state of fixing process.

According to such structure, especially when performing the fixing process, the heat roll is controlled to either a first or a second set temperature enabling fixing. That is, according to the state of the fixing process, for example when fixing process is not performed, or the fixing process is continuously performed, the first and the second set temperatures will be set to an appropriate temperature, and controlled so as to be switched between the two temperatures. This enables temperature control of the heat roll corresponding to the state of temperature rise of the pressurization roll, which not only enables a stable fix constantly without the occurrence of fixture disorder, but also prevents hot offset simultaneously.

In order to gain the above-mentioned effect, in the fixing device of the above-mentioned image forming device, the switching control between said first or second set temperature corresponding to the state of said fixing process is performed so that it is set to the first set temperature at the time of starting the heat roll at the time of switching on of the power, and after a predetermined time or during continuous fixing process, it is switched to the second set temperature. At the initial starting time, the heat roll will be heat controlled to the first set temperature, which enables a stable and good fixing of the toner image by sufficient heat, even when the temperature of the pressurization roll is not raised so much. Further, since the temperature of the pressurization roll is not raised, there is no fear of hot offset caused by the image holding body being heated from the back surface. When the fixing process is in a continuous state, it is switched to the second set temperature, so the pressurization roll will also be heated gradually, and the heat thereof will be raised. At this time, when the surface temperature of the heat roll is reduced, the heat from the pressurization roll will provide a sufficient fix, but hot offset could simultaneously be prevented since the surface temperature of the heat roll is reduced.

Further, in the fixing device having the above-mentioned structure, when the surface temperature of said heat roll is controlled to maintain the second set temperature, the surface temperature of said heat roll will be switched to the first set temperature in a state where said maintaining control is left for a certain period of time without performing the fixing process, or in a state where the fixing process is started. When the heat roller is in a stand-by state at the second set temperature, the temperature of the pressurization roll will gradually be reduced. Therefore, heat quantity will be insufficient when the fixing process is started, but by switching to the first set temperature after a predetermined time with no fixing process being performed, or by switching to the first set temperature in response to the start of the fixing process, the insufficient heat quantity could be compensated sufficiently, enabling stable fixing.

On the other hand, the fixing device in the image forming device for achieving the above and the second object of the present invention comprises a heat roll whose surface is heated to a desired temperature through a heating source, and a pressurization roll for pressing an image holding body pressurized and conveyed by said heat roll towards said heat roll side, the surface of said heat roll being controlled to maintain a temperature enabling to fix a prefixed toner image formed on said image holding body by controlling a power supply to said heating source; wherein said heat roll is controlled to a first set temperature enabling fixing, and on the other hand, switching the temperature between a second set temperature enabling fixing which is lower than said first set temperature; and the surface temperature control of said heat roll is performed so that after finishing the fixing process, said heat roll is switched to said second set temperature, and controlled to maintain said second set temperature, and in response to a start of the fixing process, switching said heat roll to said first set temperature.

According to the fixing device having the above-mentioned structure, not only a good, stable fixing could be performed, but also prevention of hot offset could be realized. That is, since the temperature is controlled to either a first or second set temperature corresponding to the state of the fixing process, the surface temperature of the heat roll will be controlled according to the temperature status of the pressurization roll. Therefore, the fixing status becomes stable, and hot offset could be prevented. Further, the heat roll is controlled of its temperature by setting the second set temperature as the stand-by state, so the power quantity supplied to the power source could be reduced compared to the power quantity for heat-controlling the heat roll at the first set temperature. Therefore, unnecessary consumption of power could be reduced, thereby contributing to cutting down the use of resources.

Moreover, if a predetermined number of sheets being fixed by the fixing process is achieved when said heat roll is controlled to the first set temperature in performing the fixing process, the fixing process thereafter will be performed by the heat roll being switched to the second set temperature, thereby preventing hot offset during fixing, and maintaining stable fixing.

Even further, when said heat roll is controlled to maintain the second set temperature, and when fixing process is not performed after a predetermined set time (ts) had passed, the surface temperature of said heat roll may be controlled to a heat lower than said second set temperature not enabling fixing, and in response to the start of the fixing process at such state, the heat roll could be controlled to rise to the first set temperature, enabling much reduction of consumption power. Further, since said heat roll is controlled to rise to the first temperature in response to the start of the fixing process, no fixing disorder will occur, and the rising time could be reduced greatly compared to the rising control time after the initial switching on of the power.

PREFERRED EMBODIMENT OF THE INVENTION

Figure 1:
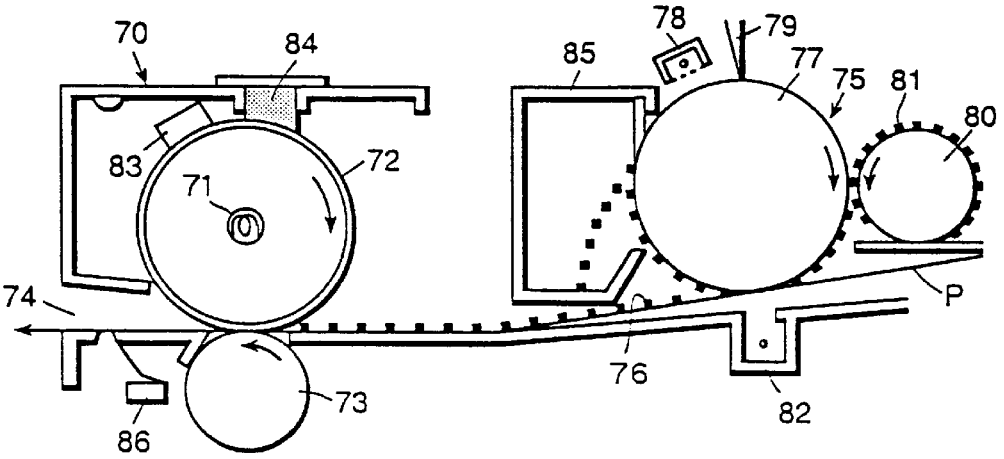
FIG.1 ( PRIOR ART )
FIG. 1 is a diagram showing the main portion of the image forming device equipped with the fixing device of the prior art.

An example of the fixing device, to which the present invention is to be applied is shown in FIG. 1. In FIG. 1, a fixing device 70 is formed of a heat roll 72 including in the interior thereof a heater lamp 71 with a halogen lamp as the heating source, and a pressurization roll 73 pressurized to said heat roll 72 by a predetermined pressurization force.

The fixing device 70 shown in FIG. 1 is positioned in front of a discharge portion 74 of the conveyance passage which passes through an image forming portion 75, wherein a toner image 76 on a sheet-type paper P formed at the image forming portion 75 is heat-fixed by being contacted to the upper heat roll 72, which provides heat, and by the pressurization force.

The image forming portion 75 forms an electrostatic latent image on the surface of a photosensitive body 77, by exposing optical information corresponding to a desired image through an optical system 79 to a surface of the photosensitive body 77 being evenly electrified by an charging apparatus 78 having an optical-conducting layer, and applying to said latent image a powder toner 81 which is the coloring agent at a developing device 80, thereby manifesting said image. The toner image on the surface of said photosensitive body 77 manifested by said developing device 80 is transferred electrostaticly by a transfer apparatus 82 positioned at the transfer position to a sheet paper P surface being conveyed into position. After said transfer, the sheet paper P comprises a prefixed toner image 76 on the surface thereof, and said paper is guided to said fixing device 70, conveyed so as to contact to said heat roll 72 by the operation of said pressurization roll 73, where the toner image is melted simultaneously by heat, and by help from the pressurization operation, a secure fix is achieved.

The heat roll 72 comprised in the fixing device 70 is equipped with the heater lamp 71 positioned inside a cylinder having a pipe of aluminum (Al) as the cored bar, the cylinder surface being covered by a silicon rubber member and the like having a good releasing character against the toner and the like. Said silicon rubber covering layer and said cored bar are adhered and fixed to each other by an adhesive called a primer, thereby forming said heater roll 72.

The surface of said heat roll 72 is maintained at a fixing temperature, in order to heat-fix said toner to the sheet paper P. Therefore, a heat detecting sensor 83 such as a thermistor is mounted in a state contacting the surface of said heat roll 72, and in response to the heat detection signal from said sensor 83, the driving control of the power supply for said heater lamp is operated, and the temperature of the heat roll 72 surface is maintained at a set temperature enabling fixing operation.

In FIG. 1, reference number 84 shows a cleaning pad for cleaning the toner and the like adhered to the heat roll 72 surface so as to prevent offset caused by said toner being transferred again to the sheet paper P, 85 is a cleaning device for removing the toner remaining on the photosensitive body 77 surface after the transfer, and 86 is a paper detecting micro-switch for detecting the sheet paper P passing though the fixing device 70 and being discharged.

Figure 2:
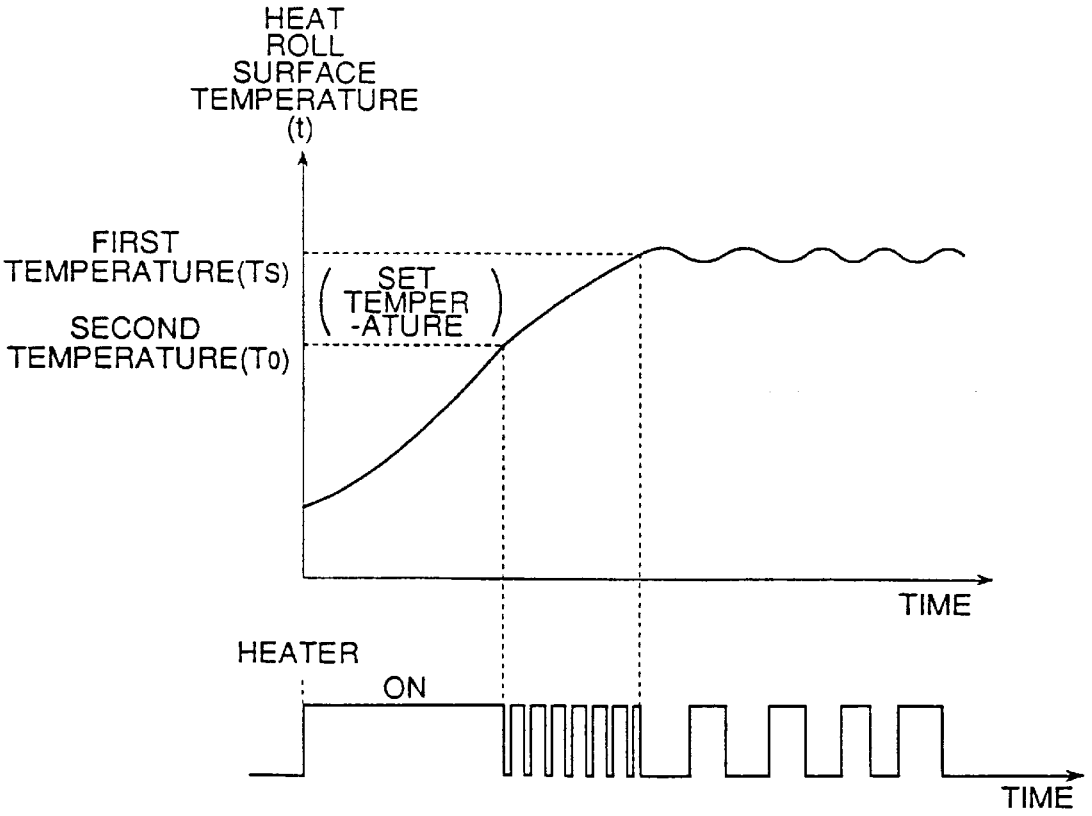
FIG.2 ( PRIOR ART )
FIG. 2 is a time chart showing the control example for maintaining the fixable temperature in supplying power to the heating source in the prior art fixing device shown in FIG. 1.

Here, an example of temperature control in the fixing device 70 in FIG. 1 is disclosed for example in Japanese Laid-Open Patent Publication No. 4-295873. As is shown in FIG. 2, it is operated so as to turn the heater lamp 71 shown in FIG. 1 on continuously so as to rapidly raise the surface temperature of the heat roll 72 to the aimed set temperature Ts, in response to turning on of the power of a copying machine and the like.

Further, by detecting the reaching of a temperature To which is under the object set temperature Ts, the power supply is controlled so as to turn the heater 71 on and off periodically, so as to prevent an overshooting caused by the rapid raise of surface temperature, reducing the ripple caused by the difference in temperature after reaching the object set temperature Ts.

Therefore, a temperature (the second temperature) To which is not aimed at performing fixing, which is lower than the set temperature (first temperature) Ts enabling fixing as the object temperature, is set in correspondence to said temperature Ts, and from the point of time where said second temperature To is detected, the control of power being supplied to the heater lamp 71 is performed. According to such operation, the overshooting after reaching the first temperature Ts is reduced, and unnecessary power supply and the like are restrained.

Figure 3:
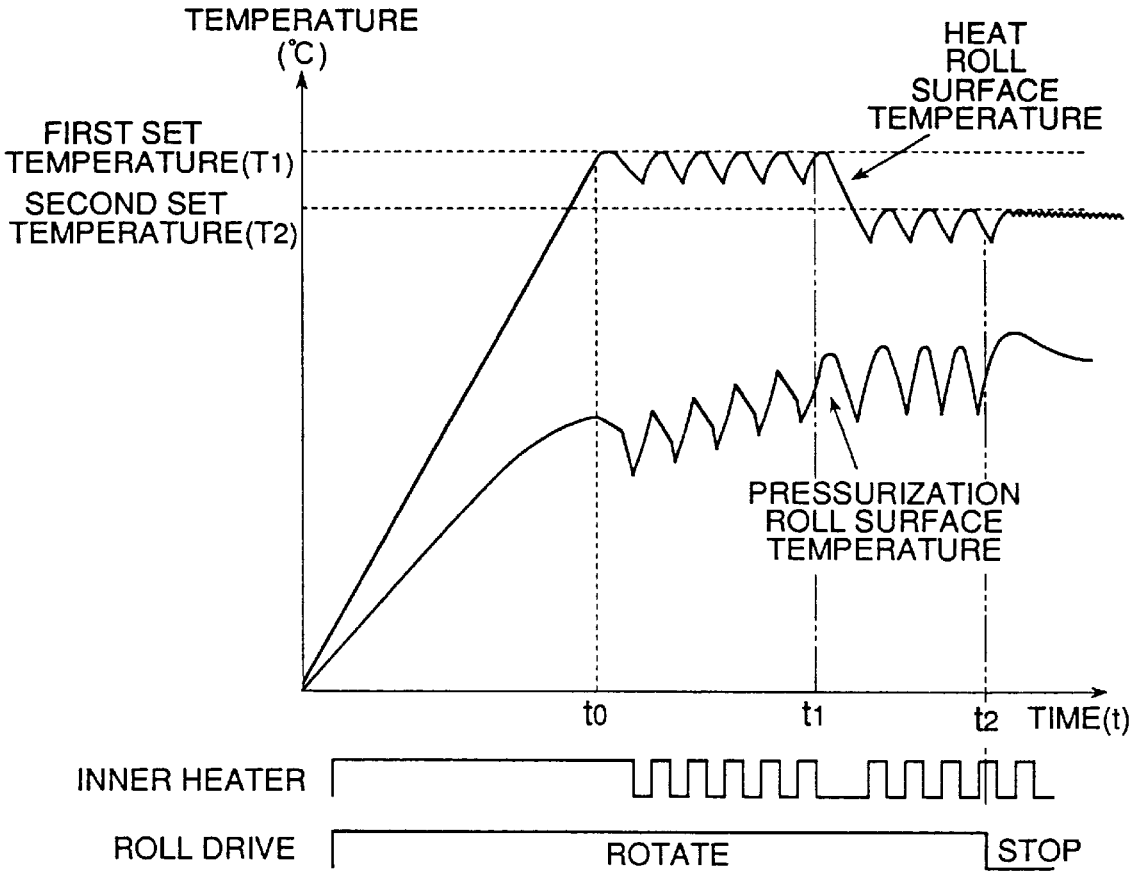
FIG. 3 is a time chart showing the temperature control in the first embodiment of the fixing device according to the present invention.
Figure 4:
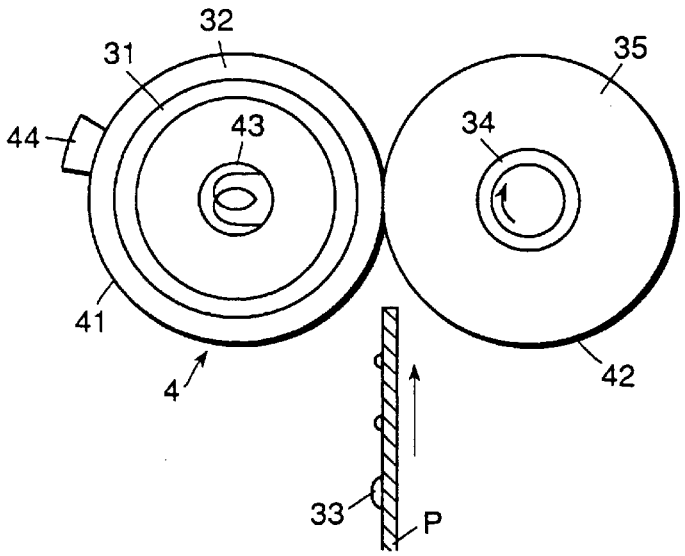
FIG. 4 is a view showing one structural example of the fixing device for fixing the toner image according to the present invention.
Figure 5:
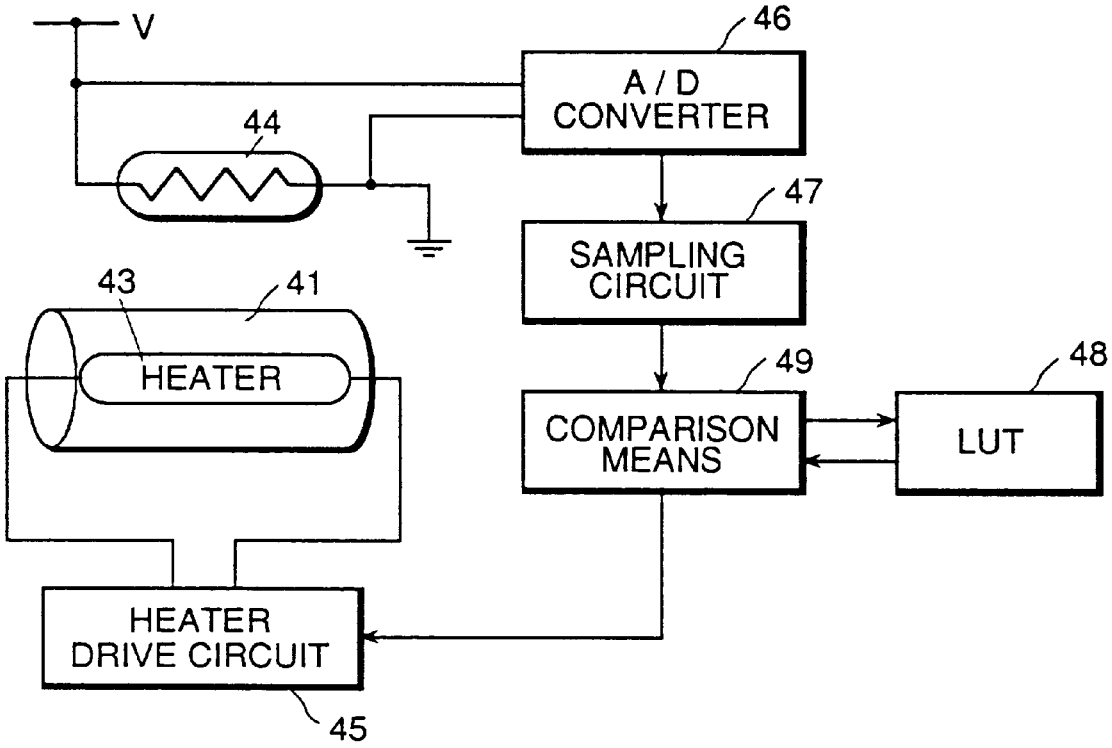
FIG. 5 is a block diagram showing the control circuit for performing the temperature control for the fixing operation by the fixing device shown in FIG. 4.

The preferred embodiment of the present invention will hereinafter be explained in detail with reference to the drawings. Especially, FIG. 3 is a time chart showing the temperature control of the fixing device for explaining the first embodiment according to the present invention. FIG. 4 is a structural view showing one example of the structure of the fixing device according to the present invention, FIG. 5 is a block diagram showing the control circuit according to the fixing device of FIG. 4, and FIG. 6 is a drawing showing the whole structure of the image forming device comprising the fixing device as shown in FIG. 4.

According to FIG. 6, the whole structure of the image forming device comprising the fixing device according to the present invention will be explained.

Figure 6:
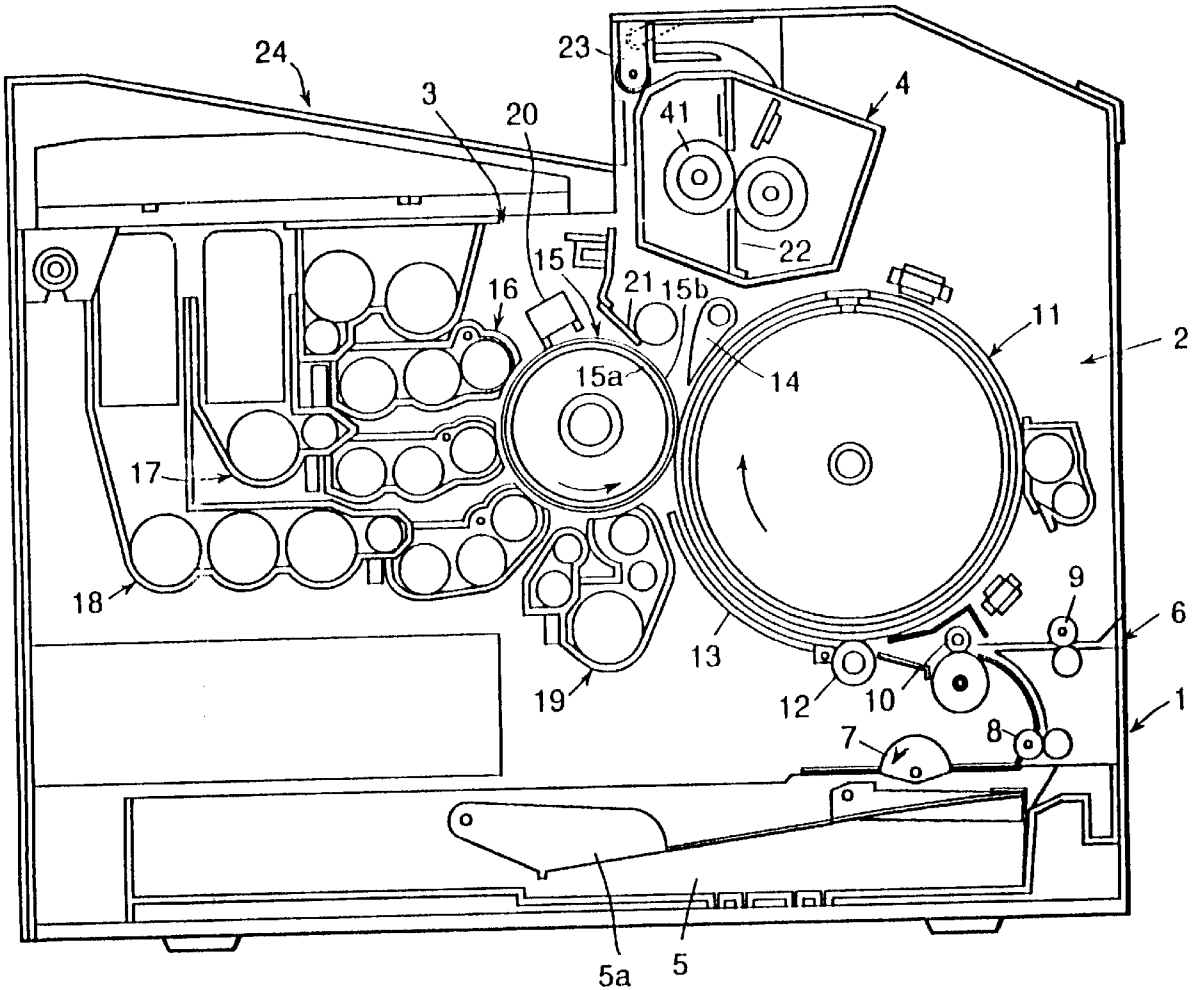
FIG. 6 is a structural diagram for explaining the broad structure of the colored image forming device comprising the fixing device of the present invention.

The image forming device shown in FIG. 6 comprises a paper feed portion 1 for storing and supplying a sheet paper as a record paper where a toner image is formed finally, a transfer portion 2 for transferring a toner image onto said sheet paper, an image forming portion 3 comprising a developing device and the like for forming a toner image, and a fixing device 4 according to the present invention for fixing the toner image transferred to the sheet by melting and adhering the same.

The paper feeding portion 1 includes a paper feed cassette 5 for storing the sheet paper and a manual feed inserting portion 6 for manually inserting the sheet paper. The paper feed cassette 5 is removably positioned at the lowest area of the image forming device body, and more particularly positioned so it is enabled to be pulled out from the front side or the right side which is the front side of the device shown in FIG. 6. The manual feed inserting portion 6 is positioned on the front side of the device body or the right hand side of the drawing. Further, a pickup roll 7 for sending out one paper at a time from the top portion of the sheet papers being stored inside the paper feed cassette 5, a PF roll 8 for conveying the sheet paper sent out by said pickup roll, and a manual feed roll 9 for conveying the sheet paper inserted from the manual feed inserting portion 6. Even further, a pre-curl roll 10 for curling the sheet paper in advance of being conveyed from said PF roll and said manual feed roll 9 is mounted thereto. These units form said paper feed portion 1. The sheet paper is sent out from said paper feed portion 1 to a transfer portion 2 according to image forming orders.

On said paper feed cassette 5 is mounted a push-up member or sheet mounting table 5a forced toward the upper direction in the drawing by a spring and the like, and on this sheet mounting table 5*a* is mounted the sheet papers. Thereby, the sheet paper stored inside said paper feed cassette 5 is positioned so that the top paper thereof is opposed to the pickup roll 7, and by the rotation of the pickup roll 7 toward the direction of the arrow, the roll contacts the top sheet, and one sheet paper will be sent out. The sent out sheet paper is conveyed to the pre-curl roll 10 by way of the PF roll 8.

Further, the sheet paper inserted from the manual feed inserting portion 6 will be conveyed to the pre-curl roll 10 through the manual feed roll 9.

Said pre-curl roll 10 curls the sheet paper in advance of being conveyed as explained above, which makes the sheet paper easily adsorbed and held at the surface of a cylindrical transfer drum 11 equipped at the transfer portion 2.

The cylindrical transfer drum 11 mentioned above is equipped to said transfer portion 2 as transfer means. On the peripheral area of said transfer drum 11, members such as a ground roll 12 as a grounded electrode member, a guide member 13 for guiding the sheet so as not to fall from said transfer drum 11, a removing pawl 14 for removing the sheet adsorbed to said transfer drum 11, and the like are positioned. Said removing pawl 14 is mounted movably so as to either contact to or separate from the surface of said transfer drum 11, which removes the sheet from the transfer drum 11 after the transfer is finished.

Further, in the image forming portion 3, a photosensitive drum 15 pressing against said transfer drum 11 is mounted as the image holding body. This photosensitive drum 15 is formed of a conductive aluminum pipe 15*a* being grounded, and an OPC film (organic optical conductive film) 15*b*, for example, is applied to the surface thereof.

On the peripheral area of said photosensitive drum 15, developers 16, 17, 18 and 19 each storing a toner of yellow, magenta, cyan, and black are positioned radially in order, and further having an electrifier 20 for electrifying the surface of said photosensitive drum 15, a cleaning blade 21 for sweeping off and removing the remainder toner on the surface of said photosensitive drum 15, and so on are positioned. In said image forming portion 3, a toner image is formed on said photosensitive drum 15 for each of said toners, and the image will be transferred one after the other on the sheet paper wound around said transfer drum 11. Therefore, according to said photosensitive drum 15, charging, exposure, development, and transfer is repeatedly performed for each color, thereby forming an image having the desired color on the sheet paper.

Accordingly, when forming a colored image on a sheet paper, a toner image is transferred to the sheet paper adsorbed electrostatically to the transfer drum 11, one color at a time for each one rotation of the transfer drum 11, thereby gaining a colored image with each color on top of the other, by a maximum of four rotations.

Further, the photosensitive drum 15 and the transfer drum 11 are pressed to each other so that a pressure of approximately 8 kg is added to the transfer position, especially in the contacting portion, from the point of view of transfer efficiency and image quality.

The toner image formed on the sheet paper by the above-mentioned method is prefixed, and in order to finish the image as permanent image, a fixing device 4 for performing heat-fixing according to the present invention is positioned corresponding to the mounting position of the removing pawl 14 of the transfer drum 11.

This fixing device 4 comprises a heat roll 41 for fixing the toner image formed on the sheet paper by a predetermined temperature and pressure, and a fixing guide 22 for guiding the sheet removed from the transfer drum 11 by the removing pawl 14 to the heat roll 41.

On the exit of the sheet of said fixing device 4, in other words, the down stream side of the sheet conveyance, a discharge roll 23 is mounted, and the sheet from the fixing device 4 is discharged to a discharge tray 24 mounted on the exterior of the image forming device body. The discharge tray 24 is positioned on the upper portion of the image forming device, and mounted in a slanted state.

Therefore, and with reference to FIG. 4, the fixing device 4 of the present invention comprises a heat roll 41 having a cylindrically shaped cored bar 31 formed of aluminum Al, and on the surface of said cored bar 31 is adhered a rubber cover layer 32 of a silicon rubber and the like having an advantageous release performance against toner, by an adhesive called a primer for example. In the interior of the cored bar 31 of the heat roll 41 is mounted a heater lamp 43 formed of a halogen lamp and the like which is a heating source for maintaining the surface temperature of the heat roll 41 to a fixable temperature (set temperature).

On said heat roll 41, a contact width (nip width) of a considerable amount is formed for fixing the toner image 33 on the sheet paper P efficiently between the heat roll 41, and in order to contact the sheet paper P to the heat roll 41 side, a pressurization roll 42 is mounted, which is formed by covering a cored bar 34 supported enabling rotation thereof with a PFA tube 35 of a silicon rubber or a sponge which is either or both thick and/or with low hardness. This pressurization roll 42 improves the adiabatic property by mounting said thick cover layer 35, and is also considered to reduce the temperature reduction of the heat roll 41 surface on the image side, and having a large nip width in the conveyance direction contacting said heat roll 41.

On the other hand, the power supply to said heater lamp 43 is controlled so as to maintain the surface temperature of said heat roll 41 to a predetermined set temperature. In order to do so, a heat detection sensor 44 formed of a thermistor and the like is mounted to a position contacting the surface of the heat roll 41. Corresponding to the output from said heat detection sensor 44, according to the control block diagram shown in FIG. 5, the control of power supply to the heater lamp 43 is performed.

In FIG. 5, the power supply to the heater lamp 43 is performed according to the drive of a heater drive circuit 45. The heater drive circuit 45 digitizes the detection signal from said heat detection sensor 44 by way of an A/D converter 46, and numerizes the same at a sampling circuit 47. Then, this converted value, and a value in a table (lookup table/LUT) storing a predetermined value corresponding to each of a set temperature and the like is compared by a comparison circuit (means) 49, and based on said compared result, the power supplied to said heater lamp 43 is controlled through said heater drive circuit 45.

Said lookup table 48 stores the value corresponding to each of said set temperature and the like, together with the value corresponding to the power quantity to be supplied to the heater lamp 43 in response to the compared result of said comparison circuit 49. The variety of control of said power quantity are, controlling the time width under a fixed voltage, controlling the power quantity under a predetermined fixed period, controlling the voltage value, or the combination of these methods, one of which is stored in said lookup table 48.

As is explained in detail later, the lookup table 48 stores a first set temperature $T_1$ and a second set temperature $T_2$ and the like enabling fixing in the present invention. By performing the switching control between said first and second set temperatures, the necessary value corresponding to the first or second set temperature is read out from the lookup table 48, compared at the comparison circuit 49, and according to the result, the power supplied to the heater lamp 43 by the heater drive circuit 45 is controlled.

Accordingly, by driving and controlling the heater lamp 43 by the circuit shown in FIG. 5, the surface temperature of the heat roll 41 is switched and maintained to either the first set temperature ($T_1$) or the second set temperature ($T_2$) enabling to heat-fix the toner image 33 corresponding to the state of fixing process.

Moreover, a halogen lamp is used as the heater lamp 43 mounted inside the heat roll 41 of the fixing device 4, but sheet heating element, ceramic heater, xenon lamp, personal-temperature control type ceramic heater (PTC) and the like could be used instead as the heating means.

The sheet heating element is formed by heating elements such as dichromic wire and the like positioned in a sheet shape, the surface thereof covered by an insulating material such as ethylene tetrafluoride or polyimide, with a shape where insulation and smoothness of the surface could be secured. When utilizing the heating element as the heat source for the fixing device of the present invention, it would show the best conducting efficiency by directly contacting to the heat roll 41 to be heated, but it could also be placed with several millimeters of distance away from the heat roll. For example, the sheet heating element is mounted by directly adhering to the inner peripheral surface of the cored bar 31 forming the heat roll 41.

The ceramic heater is formed by printing a MO system sheet heating resistor to an alumina ceramic substrate, and further laminating a glass coating by printing thereto. This ceramic heater could be heated to a predetermined heating temperature rapidly by supplying electricity to the heating resistor, and the heating surface is positioned either approximate to, or contacting to the outer circumference of the heat roll 31.

The xenon lamp is a flash lamp including a xenon gas, and when impressing high direct current pulse voltage between the electrodes on both ends of the pipe, it generates a radiation energy having a wave length of 566 nm and with a strong peak, which is highly effective in heating the heat roll 41 from the outside. Therefore, it will not be mounted in the interior of the heat roll 41, but instead, be positioned so as to oppose to the outer circumference surface of the heat roll 41.

Further, the personal-temperature control type ceramic heater is a ceramic heater, which is an element heated until the current flowing through itself when impressing voltage is below a certain value. Therefore, by selecting the material, the surface temperature of the heating element when impressing a predetermined voltage could be maintained to a predetermined temperature. This personal-temperature control type ceramic heater is either positioned approximate to, or contacting the heat roll 41, thereby heating the heat roll 41 from the outside.

[The First Embodiment of the Present Invention]

The heat roll 41 and pressurization roll 42 of the fixing device 4 according to the present invention enables to improve the picture quality, especially the picture quality of a colored image. In order to achieve high picture quality, the heat roll 41 for contacting to and fixing the prefixed toner image is covered with a silicon rubber 32 as was disclosed above.

In order to perform the fixing, it is necessary to maintain the surface temperature of the heat roll 41 to a fixed temperature, and a nip width in the pressed portion (the width which one roll is contacted to the other roll) in the pair of rolls 41 and 42 is necessary. The set temperature of the surface of the heat roll 41 and the nip width is set corresponding to the conveyance speed for conveying the sheet paper P and the toner characteristics used in the image forming device, but generally, the temperature of the heat roll 41 is set to a temperature where no fixing disorder would occur, and to a temperature where no hot offset would occur.

The surface temperature of the heat roll 41 in the fixing device according to the first embodiment explained below is controlled by setting the first set temperature $T_1$ to 160° C., and the second set temperature $T_2$ to 150° C. However, said first and second set temperatures $T_1$ and $T_2$ are set to a temperature enabling fixing, and especially, the first set temperature $T_1$ is set to a temperature enabling fixing without generating hot offset. Therefore, in the first embodiment, the temperature is set to 160° C. which is one example enabling fixing, so if said temperature is set to a higher temperature, it also would enable fixing. However, the surface temperature of the heat roll 41 should be set so as not to generate hot offset, which means that not all temperatures above 160° C. are possible.

Therefore, said fixable temperature range differs according to the shape of the fixing device 4, especially the heat capacity, the nip width and the like of the heat roll 41, wherein approximately ±35° C. to the center temperature appropriate to said fixing device could be recognized as the fixable range. In the first embodiment, as was disclosed above, the first set temperature $T_1$ is set to 160° C., and the lower second set temperature $T_2$ is set to 150° C. for explanation. In this case, the upper limit of the temperature enabling fixing without generating hot offset is possibly 170° C.

Before explaining the first embodiment of the present invention, the process in getting to the present invention will be explained below. For example, in order to fix a plurality of differently colored and laminated toner by the image forming device equipped with the present invention, for example, in a colored image forming device with a structure shown in FIG. 6, it is necessary to set the nip width to a large value, for example, to approximately 4 mm, and the surface temperature of the heat roll 41 should be set to at least 150° C. Further, the conveyance speed of the sheet paper P is set to 85 mm/sec.

The surface temperature of said heat roll 41 is detected at all times by the heat detection sensor 44 positioned so as to contact the surface of the roll, and in the surface temperature control circuit shown in FIG. 5, the power supplied to the heater 43 is controlled. Thereby, as above, the surface temperature is maintained at 150° C. At this time, the surface temperature of the heat roll 41 is controlled to 150°±5° C., enabling fixture of toner with a state of high picture quality.

Therefore, the fixing device 4 sets the conveyance speed of the sheet P, especially the line speed of the roll pair 41, 42 to 85 mm/sec, and the nip width thereof to 4 mm. The surface temperature of the heat roll 41 for fixing toner is set to 150° C., performing heat control at the circuit shown in FIG. 5 in order to maintain said temperature.

However, raising the fixing device 4 in response to switching-on of the power of the image forming device to the above-mentioned conditions, and maintaining the surface temperature of the heat roll 41 to 150° C. will still cause a low brightness in the colored image and a low fixing strength. In other words, when the power is switched on, the heat roll 41 is set so as to rise to a surface temperature of 150° C., and at that temperature the image forming body hopefully provides a state to form images, however, it causes some problems as described above.

That is, when the surface temperature of the heat roll 41 in the fixing device is raised to a fixable temperature, or 150° C., and then image forming, and fixing process accompanied therewith, is started when maintaining such state, it was recognized that the fixing property of the initial toner image was unfavorable. The reason for this was that the pressurization roll 42 is rotated in response to the rotation of the heat roll 41 when starting the image forming, thereby being heated. Therefore, the temperature of the pressurization roll 42 is low at the initial time, but rises when fixing the toner image. The heat of the heat roll 41 will be taken by the pressurization roll 42, and the fixing property of the toner image at the initial time of rising of the fixing device becomes unfavorable.

When controlling the surface temperature of the heat roll 41 to a higher temperature than 150° C., for example to 160° C., the fixing property of the toner image at the initial rising time becomes favorable. However, when the fixing process is performed continuously, hot offset occurred after approximately fixing 10 sheets, when using thin paper (60 g paper for example) as the sheet paper P. Therefore, continuous and stable fixing process was not possible when maintaining the heat roll 41 to a temperature of 160° C. constantly.

Therefore, in the present invention, the temperature for maintaining the heat roll 41 to a fixable temperature as mentioned above was set to two temperatures, the first set temperature $T_1$ being 160° C. in the first embodiment, and the second set temperature $T_2$ being 150° C., and controlling the temperature by switching between the two kinds of set temperatures corresponding to the state of fixing process, improving the fixing property at all times, and preventing hot offset.

The control state of the first embodiment of the present invention is shown in FIG. 3, which is explained hereinafter with reference to said drawing. In order to start the image forming device explained in FIG. 6, the power switch-on operation is performed., and in response to this switch-on, an initial rising control will also be performed at the fixing device 4. In this rising control, the surface temperature of the heat roll 41 is set to a high value. For example, the surface temperature of the heat roll 41 is set to 160° C. In FIG. 3, the surface temperature of the heat roll 41 at the time of power switch-on is initially controlled of its temperature to a first set temperature $T_1$, which is set, for example, to $T_1$=160° C.

When the heat roll 41 is raised of its heat to the first set temperature $T_1$, and in the state where image forming operation by the image forming device is possible (stand-by state), order for starting the image forming is provided. At this time, the image forming is started, the fixing process being performed in response, and after a continuous processing by said fixing process is repeated for a predetermined number of times (the number of sheet paper passing through), the heat control of the surface temperature of the heat roll 41 is controlled to a second set temperature $T_2$ which is lower than the first set temperature (for example, $T_2$=150° C.).

Therefore, when the power of the image forming device is switched on, the heat roll 41 of the fixing device is controlled so as to heat the heat roll 41 of the fixing device to the first set temperature $T_1$. At this time, as is shown in FIG. 3, the one pair of rolls 41 and 42 are simultaneously rotated so that the pressurization roll 42 will also be heated.

When the surface temperature of the heat roll 41 is raised to the first set temperature $T_1$ (=160° C.), it is controlled so as to maintain said temperature. At this time, the driving movement of the one pair of rolls 41 and 42 are stopped, and the image forming device is in a stand-by state enabling image forming. FIG. 3 shows a state where the image forming operation is started from the time to where the heat roll 41 is raised to the first set temperature $T_1$, and continuing from the point where the rising control is completed, a continuous fixing process is operated.

Therefore, when the sheet paper P passes through the pair of rolls 41 and 42, the surface temperature thereof will decrease since heat will be taken by said sheet. However, in the state where no sheet paper P passes, the surface temperature of the pressurization roll 42 will be increased gradually.

When this continuous image forming, or fixing process is performed, the surface temperature of the pressurization roll 42 will be raised gradually, and when the number of continuous sheet paper P exceeds a predetermined number, hot offset will occur. That is, when the pressurization roll 42 is heated to over a predetermined temperature, the toner on the sheet paper P will be heated from the back surface, and hot offset occurs where the toner adheres to the heat roll 41.

Therefore, at time t1 that is, when (t1) the continuous fixing number of papers exceeds ten sheets, for example, the set temperature of the heat roll 41 is decreased to the second set temperature $T_2$ (=150° C.) in the temperature control. Thereafter, the heat roll 41 is controlled of its temperature to the second set temperature $T_2$. This solves the problem of hot offset, and enables a stable fixing.

Further, according to FIG. 3, when the fixing process operation is finished after a continuous image forming, the heat and pressurization rolls 41, 42, being rotary driven are stopped at the point of time t2, being in a stand-by state for the next fixing operation, and the heat roll 41 is controlled to maintain the second set temperature $T_2$. As for the pressurization roll 42, the temperature will be reduced gradually since no sheet paper P passes through the pair of rolls, but there is no great reduction of temperature. At the time of fixing for the next image forming operation, the surface temperature control of the heat roll 41 is performed at the second set temperature $T_2$. Under such control, the pressurization roll 42 is heated sufficiently since continuous fixing was performed in advance. Therefore, a fixing process could be performed without the occurrence of fixing disorder, maintaining a sufficient brightness in the fixing of colored images, and in a state of high picture quality, with no occurrence of hot offset.

However, when the image forming operation is not performed for a predetermined period of time, and the image forming device is left in an ignored state, the surface temperature of the pressurization roll 42 will be reduced gradually. Therefore, when the image forming operation is still not operated after a predetermined time has passed, as is shown in the initial rising process of FIG. 3, the surface temperature of the heat roll 41 is switched to be controlled to the first set temperature $T_1$. Similarly, when the fixing process is finished after a continuous image forming of a predetermined number of papers, the temperature control thereof is switched to the second set temperature $T_2$.

As above, at the initial time where no image forming operation is performed, the surface temperature of the heat roll 41 is controlled to the first set temperature $T_1$ which is comparatively higher. When the fixing process by a continuous image forming is continued for the predetermined number of papers, after said predetermined number of papers, the surface temperature of the heat roll 41 is controlled so as to be switched from the first set temperature $T_1$ to the second set temperature $T_2$. Thereby, the fixing property of the toner image is maintained at a good state, and at the same time, a stable fixing operation solving the problem of hot offset is made possible. Further, the fixing property of a high picture quality could be maintained.

[Working Example]

The effect and the like of the first embodiment explained above and shown in FIG. 3 is confirmed hereinafter, and the results and the like is shown of the experiment for performing a fixing maintaining a high picture quality or a hot offset state by the number of papers in the continuous fixing process of the continuous image forming.

The image forming device is a colored image forming device as shown in FIG. 6, the nip width of the heat roll 41 and the pressurization roll 42 of the fixing device 4 set to 4 mm, and the line speed (the conveyance speed of the sheet) by the rolls 41 and 42 is set to 85 mm/sec, when performing the fixing process. The surface temperature of the heat roll 41 at this time is set to the first set temperature $T_1$. The temperature at that time is 160° C.

When the power of the image forming device is switched on, the surface temperature of the initial heat roll 41 is controlled to the first set temperature $T_1$, and after it is raised, the initial continuous image forming is performed. At this time, the sheet paper P used for performing the continuous image forming is a thin paper (60 g paper) when the fixing process is performed by the fixing device 4.

By the experiment, in a continuous image forming, hot offset occurred from the tenth paper of the sheet paper P. When this hot offset occurs, the toner adhered to the heat roll 41 is re-transferred to the next sheet paper P, thereby deteriorating the image, and the formed image will be ruined.

Further, when performing a continuous image forming, if the distance between the sheet papers P is set to a somewhat larger value, that is, if the passing number of sheet P through the fixing device 4 per unit time is reduced, for example, hot offset occurred from the eighth paper. This is because the pressurization roll 42 was heated for a longer time by the heat roll 41 with no paper passing through, and therefore, the surface temperature of the pressurization roll 42 was rapidly raised.

From the above results, and in consideration of not producing hot offset, the surface temperature of the heat roll 41 is switched from the first set temperature $T_1$ to the second set temperature $T_2$ starting with the sixth paper passing through the fixing device 4. In other words, the surface temperature control of the heat roll 41 is performed to the first set temperature $T_1$ to the fifth paper and from the sixth paper on the surface temperature control of the heat roll 41 is performed to the second set temperature $T_2$. It was confirmed that a stable fixing was performed under a good fixing state, with no occurrence of hot offset, by such an operation.

As was explained above, when the temperature control of the heat roll 41 is performed by the second set temperature $T_2$ and the fixing process is performed for more than twenty sheets continuing the image forming, the surface temperature of the pressurization roll 42 is raised completely, and heated to a saturated temperature. After finishing such continuous image forming, at a state where the surface temperature of the pressurization roll 42 is saturated, the next image forming is started and in response, the fixing process is performed, if the temperature is switched to the first set temperature $T_1$ when performing the fixing process, not only hot offset occurs, but also the brightness when fixing a colored image to a thick paper is raised, with too much difference of brightness from the image right after the rising of temperature, therefore, a stable image quality could not be gained.

Therefore, the stand-by term (ignored term) from the completion of continuous fixing process enabling the switch from the second set temperature $T_2$ to the first set temperature $T_1$, to when the next fixing process is started was examined. That is, the confirmation on how long a time it took for the pressurization roll 42 to reduce its temperature in an ignored state, enabling to maintain a good and fixed picture quality by switching to the first set temperature T1, was performed.

As a result, by leaving the device for approximately five minutes, the temperature of the pressurization roll 42 was reduced to a temperature where a stable fixture could be performed maintaining a good fixing property when switching the temperature to the first set temperature $T_1$. Further, when the temperature control maintaining the second set temperature $T_2$ was performed after leaving the device for more than five minutes, the brightness in a conventional paper was low, and the picture quality was in an unstable state.

Therefore, when image forming is performed continuously at a second set temperature $T_2$ at the fixing device 4, during a set time from when the image forming is completed to when the start the next image forming is ordered (in the example, within approximately five minutes), the temperature is controlled so as to maintain the second set temperature $T_2$. By controlling the temperature so as to switch from the second set temperature $T_2$ to the first set temperature $T_1$ after a time exceeding the set time has passed (in the example, approximately five minutes), a stable fixing was made possible for the fixing process in the following image forming operation.

As is disclosed in the above example, the temperature control of the heat roll 41 is performed so that it is raised to the first set temperature $T_1$ which is comparatively high in the temperature range enabling fixing in the initial time, maintaining the image forming device in the stand-by state. When the image forming operation is started and image forming is continued, after image forming of a predetermined number of sheets is finished, for example, five continuous sheets, the temperature control is switched to the second set temperature $T_2$. Thereby, a stable fixing is made possible with a good fixing property, and with a fixed picture quality.

In the state where the heat roll 41 is controlled of its temperature by the second set temperature $T_2$, when the image forming device is in a stand-by status and left with no image forming operation for a predetermined time, five minutes for example, and when image forming is started again after said predetermined time (five minutes) has passed, the surface temperature of the heat roll 41 is switched at that time to the first set temperature $T_1$ for control. Thereby, a stable fixture could be performed by the next fixing process, solving the fixing disorder and the like. Even in this image forming process, after image forming of a predetermined number of sheets is continuously performed, the surface temperature of the heat roll 41 thereafter is switched and controlled to a second set temperature $T_2$. Therefore, a stable fixing is enabled constantly, and the problem of hot offset is solved simultaneously.

Figure 7:
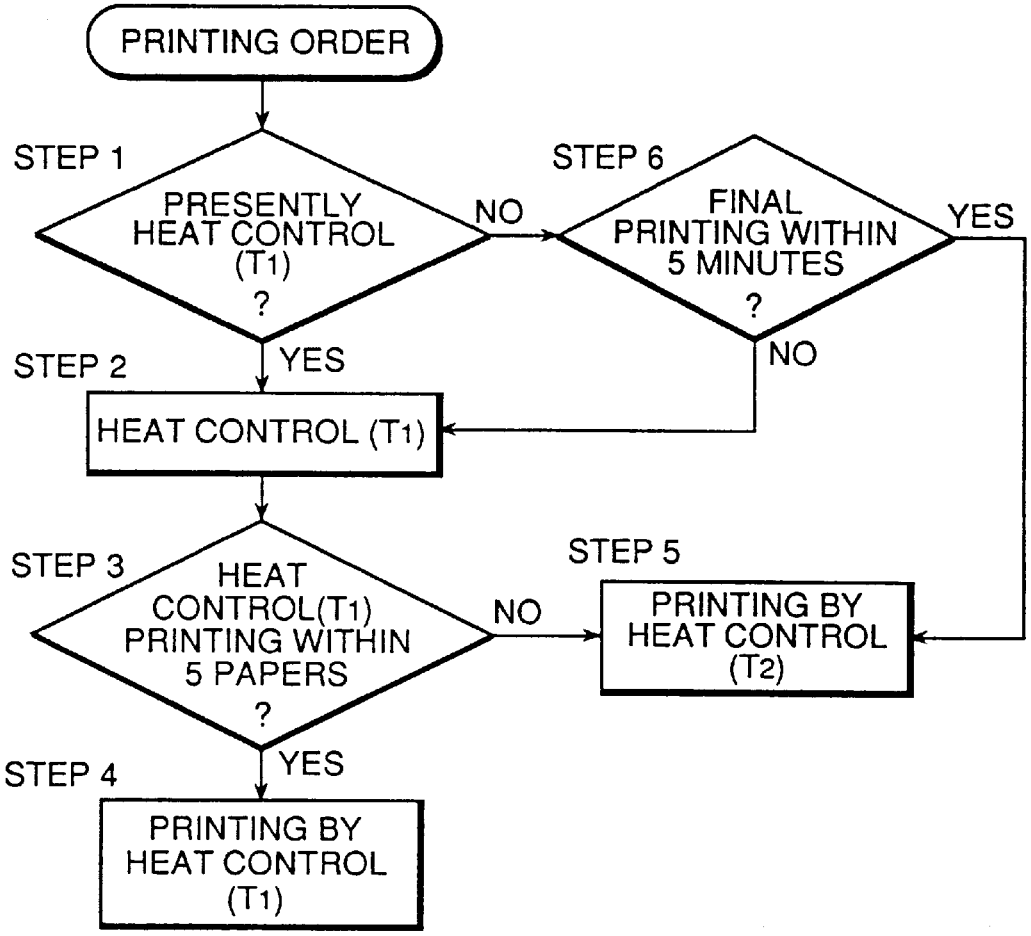
FIG. 7 is a flowchart showing the steps for the switching control between the first and the second set temperatures according to the first embodiment of the present invention.

FIG. 7 is a control flowchart for performing the fixing process by switching the heat roll 41 to either a first or a second set temperature $T_1$, $T_2$ corresponding to the fixing process status in the fixing device 4 as was explained above.

The first embodiment of the present invention is explained in reference to FIG. 7. When the image forming device is at a stand-by status, printing order, that is, order for performing the image forming is provided. At this time, the image forming device body performs a paper feeding of a sheet paper P having a desired size, and the image forming device 3 starts the image forming by each of the colored toners onto the photosensitive drum 15. Said sheet paper P is sent to the transfer drum 11 for transferring the formed image, and adhered electrostatically thereto, getting ready for transfer.

Simultaneously with the above operation, the temperature control of the heat roll 41 is performed in the fixing device 4 by the present invention. Accordingly, in step 1 the temperature control status of the heat roll 41 is confirmed. That is, confirmation is performed to determine whether or not the temperature of the heat roll 41 is to be controlled or maintained at the first set temperature $T_1$. If the temperature control of the heat roll 41 is to be so controlled (YES, step 1), then the temperature control of the heat roll 41 is maintained at the first set temperature $T_1$ in step 2.

Then, it is confirmed whether or not continuous image forming by the image forming device is within five sheets or not (step 3), and if it is within five sheets, the temperature control by the first set temperature $T_1$ is performed, and fixing process is performed accordingly (step 4). Therefore, the flow of control explained above is the temperature control of the initial image forming after it is set to a stand-by state by the power switch-on.

During image forming operation, if the continuous image forming number of sheets exceeded five sheets in step 3, the temperature control of the heat roll 41 is switched from the first set temperature $T_1$ to the second set temperature $T_2$, and the fixing process (step 5) of the image forming is performed accordingly. Therefore, the temperature of the heat roll 41 is reduced to the second set temperature $T_2$ since the pressurization roll 42 is sufficiently heated, and the problem of hot offset is solved.

On the other hand, when image forming order is provided when the present temperature control state by the heat roll 41 is performed by the second set temperature, process is advanced from step 1 to step 6, where confirmation is made on whether five minutes has passed or not from the final printing, that is, when the image forming operation was completed. If five minutes have elapsed, the pressurization roll 42 has been cooled from the ignored state, and the back surface of the sheet P could not be heated sufficiently. Therefore, the surface temperature of the heat roll 41 is controlled so as to be switched from the second set temperature $T_2$ to the first set temperature $T_1$ by way of step 6 to step 2, performing the above-disclosed fixing process.

If the ignored time of the image forming device is within five minutes, the temperature control of the heat roller 41 is maintained at the state of the second set temperature, and fixing process is performed by step 5. As was explained above, by switching the control to the first or second set temperature $T_1$, $T_2$ corresponding to the ignored time of the image forming device, a stable fixing with a good fixing property could be performed, simultaneously solving the problem of hot offset.

[The Second Embodiment of the Present Invention]

In the first embodiment, the temperature control of the heat roll 41 corresponding to the start of the initial image forming operation from the stand-by state enabling image forming after the power switch-on of the image forming device and the temperature control at the state where the image forming device is ignored was explained.

The second embodiment relates to a control method for performing the temperature control by the first embodiment of the present invention enabling stable fixing process, solving the problem of hot offset, and reducing power consumption. That is, when controlling the heat roll 41 to a fixable temperature, the unnecessary power supply is omitted, and the temperature control according to the present invention is enabled.

Figure 8:
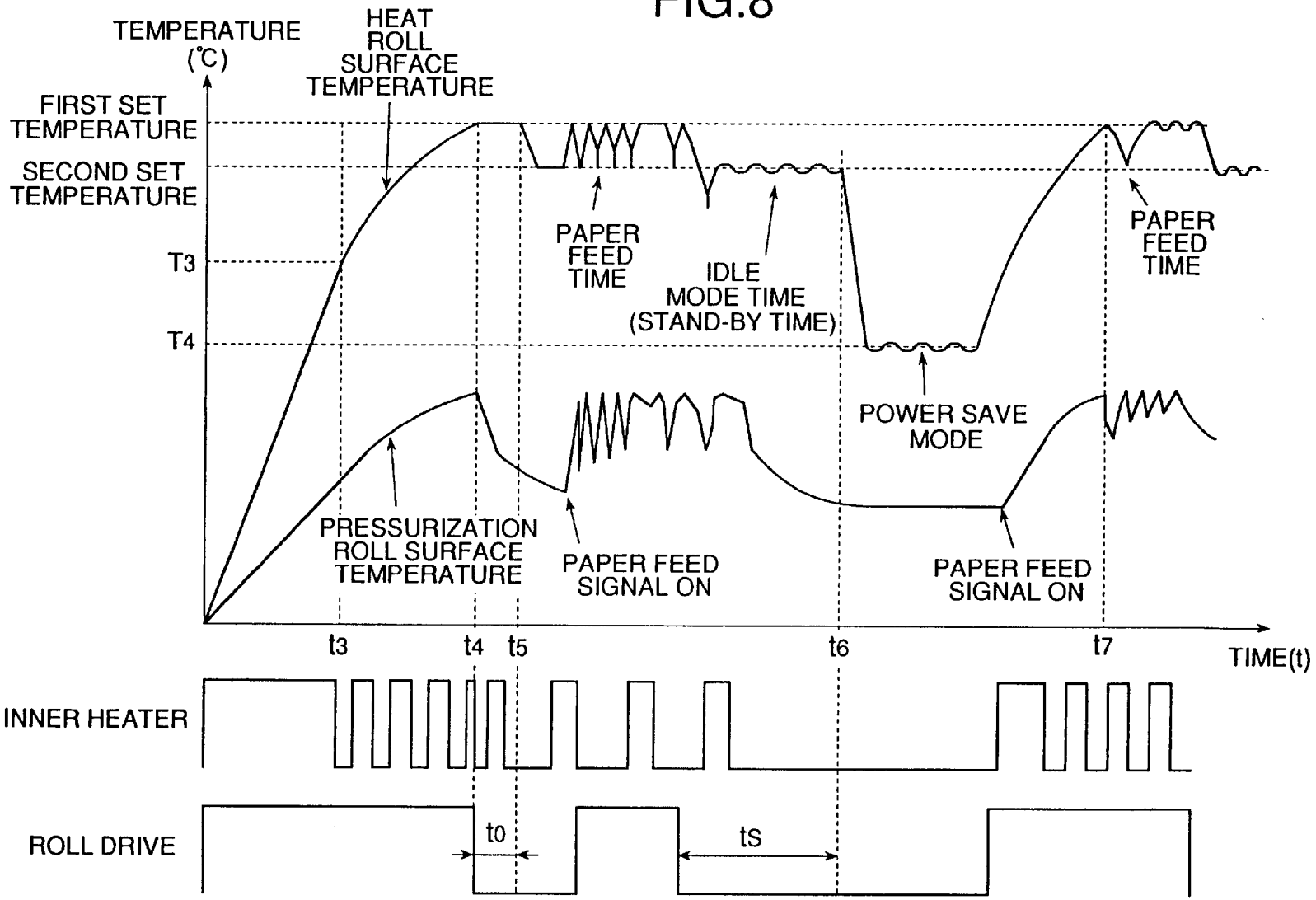
FIG. 8 is a time chart according to the temperature control of the fixing device for explaining the second embodiment of the present invention.

FIG. 8 shows the time chart of said temperature control. In the drawing, at first, the power of the image forming device is turned on, and procedure for controlling the heat roll 41 to the first set temperature $T_1$ is performed.

In FIG. 8, from the time of power switch-on, power control to the heater of the heat roll 41 is controlled according to the first set temperature $T_1$. The power at this time is driven at a maximum value enabled to be used by the fixing device 4 of the image forming device. Therefore, the rising curve of the surface temperature of the heat roll 41 becomes rapid. In the attempt to reduce the overshooting of the heat roll 41 exceeding the first set temperature $T_1$, a third set temperature $T_3$ which is lower than the second set temperature is set, and when the surface temperature of the heat roll 41 reaches this third set temperature, the electric power supplied to the heater 43 of the heat roll 41 from the point of time t3 is controlled to ½ (half) the maximum value disclosed above. Thereby, the rising curve of the surface temperature of the heat roll 41 is weakened, and the time for rising to the first set temperature $T_1$ is delayed.

However, the overshooting exceeding the first set temperature $T_1$ and the power supply is reduced, thereby overshooting by excess of 20° C., for example, will be gone. Further, problems such as the cover layer 32 coming off from the cored bar 31 forming the heat roll 41 will no longer happen. Further, the unnecessary supply of power could be reduced.

By controlling the power supply as above, and the surface temperature of the heat roll 41 is heated to reach the first set temperature $T_1$, the power supply to the heater 43 will be stopped from that point of time t4, and simultaneously, the rotation of the heat roll 41 including the pressurization roll 42 will be stopped. In such case, it is shown in the drawing that the heat roll is driven to rotate simultaneously in response to the power switch-on, but it could be set to start rotation at the time t3 where the heat roll 41 reached the third set temperature $T_3$.

When the surface temperature of the heat roll 41 reaches the first set temperature $T_1$, the image forming device is in a stand-by state, displaying the message that image forming is possible. From that point of time t4, when the device is left for a predetermined time (to) without the image forming operation being started, the power supply for maintaining the heat roll 41 to the first set temperature T1 is wasted. Therefore, in the second embodiment, in the case where the device is left as above (t5), the surface temperature of the heat roll 41 is switched from the first set temperature $T_1$ to the second set temperature $T_2$ which is lower, since the fixable second set temperature $T_2$ is set in advance.

By controlling the temperature of the heat roll 41 to the second set temperature $T_2$, the power quantity supplied to the heater 43 could be reduced compared to the power quantity where the first set temperature is maintained. That is, the surface temperature of the heat roll could be maintained at a lower temperature, enabling reduction of the supplied power quantity.

When the temperature of the heat roll 41 is controlled at the second set temperature $T_2$, if the order to start image forming operation is provided (paper feed signal ON), the heat roll 41 is switched from the second set temperature $T_2$ to the first set temperature $T_1$ at this time. In this case, it will take a comparatively long time from the order to start the image forming to the sheet paper P to pass through the contact portion of the heat roll 41 and the pressurization roll 42 in the fixing device. Especially when forming a colored image, four kinds of toners at most must be laminated onto the first one piece of sheet, and it takes approximately one minute of time. Therefore, during that time, the surface temperature of the heat roll 41 could be raised sufficiently to the first set temperature $T_1$.

By performing a fixing process by the heat roll 41 being driven by the temperature control of the first set temperature T1, a good fixing of the toner onto the sheet paper P could be performed. The control by said first set temperature $T_1$ is switched to the second set temperature $T_2$ in order to solve the problem of hot offset when the feed number of the sheet paper P has reached a predetermined number, especially to a number where the surface temperature of the pressurization roll is to be heated sufficiently, and by such temperature, the power control to the heater 43 is performed. By performing a power control by a lower set temperature, for example, the second set temperature $T_2$, compared to the conventional method, the power quantity could be reduced.

After the image forming is completed when the temperature control for fixing process in the image forming operation is performed as above, the rotary movement of the heat roll 41 and the pressurization roll 42 is stopped, and the device is in a stand-by state where image forming is possible. During said stand-by state, in order to reduce the consumption of power quantity, the heat roll 41 is controlled of its heat by switching to the second set temperature $T_2$. Thereby, the power supplied to the heater 43 could be reduced.

When the image forming device is left for a long period of time, the minimum power supply is necessary when controlling the heat roll 41 to the second set temperature $T_2$. In order to further reduce the waste of power, if the device is ignored for more than a predetermined time (ts) after the image forming operation has finished, and no order to start the image forming is provided, it is controlled to a fourth set temperature $T_4$ which is even lower than the third set temperature $T_3$. The fourth set temperature $T_4$ is set, for example, to approximately 100° C. This enables further and greater reduction of the power quantity supplied to the heater 43, thereby greatly reducing unnecessary power supply.

Any time could be set as said predetermined time ts, and normally, approximately five minutes is set as the time ts. However, times like 20 minutes or 30 minutes could also be set. Said fourth set temperature $T_4$ is not enabled to provide fixing at such temperature. Therefore, it is set as a power save mode.

Therefore, when the order to start image forming by the image forming device is provided at this power save mode, the control to raise the heat roll 41 to the first set temperature $T_1$ is performed. At this time, similar to that of the initial power switch-on, the maximum power that could be supplied is driven, until the surface temperature of the heat roll 41 is raised to the third set temperature $T_3$. Thereafter, in order to rise the temperature from the third set temperature $T_3$ to the first set temperature $T_1$, the control described above is performed.

When the surface temperature of the heat roll 41 is raised to the first set temperature $T_1$, the sheet paper P is fed through the heat roll 41 and the pressurization roll 42 from the point of time t7, and fixing process is performed. In such case, the heat roll 41 is heated to a predetermined temperature compared to the power switch-on time, the time taken to be raised to the first set temperature $T_1$ is very short, and the waiting time for performing the feeding of the paper is almost none.

As was explained above, also in the second embodiment, the surface temperature of the heat roll 41 is controlled to the first set temperature $T_1$ and a second set temperature $T_2$, where stable fixing is performed constantly without the fixing ability being ruined, and without the occurrence of hot offset. Further, the control of maintaining the heat roll 41 to a predetermined temperature is performed by the minimum power quantity, which cuts down the unnecessary power usage, and greatly reduces the consumption power.

Since there is no unnecessary power consumption, the temperature rise inside the image forming device could be restrained, thereby reducing the driving power of the fan and the like for cooling the interior of the image forming device.

[The Third Embodiment of the Present Invention]

In the first and second embodiments disclosed above, the surface temperature of the heat roll 41 is controlled to be switched to a first or a second set temperature in response to the fixing process status at the fixing device 4. In other words, the switching control between the first and the second set temperature $T_1$, $T_2$ is performed based on the heated status of the pressurization roll 42, especially the surface temperature status.

Therefore, if the cost allows, a sensor for detecting the surface temperature which is similar to the heat detection sensor 44 on the heat roller 41 side shown in FIG. 4 may be provided to the pressurization roll 42 side, and based on the detection, the surface temperature of the heat roll 41 could be switched to the first or second set temperature $T_1$, $T_2$.

In other words, when the surface temperature of the pressurization roll 42 rises, such state is detected by the heat detection sensor, and at that time, the surface temperature of the heat roll 41 is controlled to the second set temperature $T_2$. When the device is left ignored with no fixing process being performed, and when the sensor detects the decrease of temperature of the pressurization roll 42 below a predetermined temperature, the surface temperature of the heat roll 41 is switched and controlled to the first set temperature $T_1$.

Therefore, the temperature on the pressurization roll 42 side is detected directly, and the status of the fixing process by the pressurization roll is detected correctly, thereby enabling a more accurate fixing property by switching the set temperature of the heat roll according to such status.

The third embodiment could only be carried out by mounting a sensor for directly detecting the temperature of the pressurization roll 42, and when such heat detection sensor could not be mounted, the first and second embodiments mentioned above could be performed for the stable fixing process preventing hot offset.

Further, a colored image forming device is used as the example to explain the image forming device applying the present fixing device. However, the present invention could be applied to any image forming device with the need for a fixing device of a toner. Further, the number of papers continuously being fed to the fixing device in the image forming device when switching from the first set temperature to the second set temperature is five pieces in the third embodiment, but this is only one example, with any number enabled to be set for each of the image forming devices. For example, the heat capacity of the fixing device and the like could be set to an appropriate number by experiment and the like, when the number of continuously fed papers is changed.

According to the fixing device of the present invention, the surface temperature of the heat roll forming the fixing device is set to a fixable first set temperature and a second set temperature which is lower than the first set temperature, where the set temperature is switched corresponding to the processing status, thereby enabling performance of a stable fixing process at all times without the reduction of fixing ability. Further, the problem of hot offset occurring at the time of continuous image forming is solved, and no deterioration will occur to the picture quality.

Further, at the initial time of continuous image forming, the fixing process could be performed by the first set temperature, thereby enabling a good fixing without the reduction of fixing ability, and after a predetermined number of papers have been fixed, the temperature is controlled to the second set temperature, which maintains the fixing ability and at the same time prevent hot offset.

Further, by performing the temperature control of the heat roll by the present invention, hot offset could be prevented even when performing a continuous fixing process by thin paper.

Even further, at the time of stand-by of the image forming device, unnecessary power consumption could be cut down by controlling to the second set temperature, and at the time of starting the fixing process operation, it is controlled to the first set temperature, which enables no deterioration of the fixing ability and the like, maintaining the effect by the above-mentioned advantageous fixing process.

I claim:

1. A fixing device in an image forming device comprising:

a heat roll whose surface is heated to a desired temperature by a heating source;

a pressurization roll for closely contacting an image holding body to said heat roll;

wherein the surface of said heat roll is controlled and maintained at a temperature enabling fixing of a prefixed toner image formed on said image holding body;

wherein said heat roll surface temperature is controlled and maintained at one of a first set temperature enabling fixing of the prefixed toner image and a second set temperature enabling fixing of the prefixed toner image, the second set temperature being lower than the first set temperature;

wherein after said fixing device completes a fixing process, said heat roll surface temperature is switched to said second set temperature and is controlled and maintained at the second set temperature, and in response to the start of another fixing process, said heat roll surface temperature is switched to the first set temperature; and wherein said heat roll surface temperature is controlled and maintained at the first set temperature during a warming-up process of the heat roll.

2. A fixing device in an image forming device according to claim 1, wherein during the time said heat roll surface temperature is controlled to the first set temperature the heat roll surface temperature is switched so as to be controlled to the second set temperature after a predetermined number of a plurality of image holding bodies have passed through said fixing device.

3. A fixing device in an image forming device according to claim 2, wherein said heat roll surface temperature is controlled to a temperature, lower than said second set temperature, which is not capable of providing fixing when said heat roll is controlled and maintained to the second set temperature and another fixing process is not performed after a predetermined time (ts) set in advance has passed, and in response to the start of said another fixing process while in such a state, the heat roll is started and said heat roll surface temperature is controlled to the first set temperature.

4. A fixing device in an image forming device according to claim 2, wherein during the time said heat roll surface temperature is being controlled and maintained at the second set temperature, said heat roll surface temperature is switched to the first set temperature when said fixing device is left for a predetermined time without performing said another fixing process.

5. A fixing device in an image forming device according to claim 1, wherein during the time said heat roll surface temperature is controlled to the first set temperature said heat roll surface temperature is switched so as to be controlled to the second set temperature after a predetermined time elapses or during a continuous fixing process.

6. A fixing device in an image forming device according to claim 1, wherein said heat roll surface temperature is controlled and maintained by controlling a power supply to said heating source.

* * * * *